United States Patent [19]

Jaworowski et al.

[11] Patent Number: 4,886,552

[45] Date of Patent: Dec. 12, 1989

[54] METHOD FOR MONITORING THE REMOVAL OF A METALLIC CONTAMINANT FROM THE SURFACE OF A METALLIC ARTICLE

[75] Inventors: Mark R. Jaworowski, Enfield; Gary A. Gruver, South Windsor, both of Conn.

[73] Assignee: United Technologies Corporation, Hartford, Conn.

[21] Appl. No.: 242,759

[22] Filed: Sep. 9, 1988

[51] Int. Cl.[4] ..... C23G 1/02; C23G 1/08; C23G 1/10; C23G 1/12

[52] U.S. Cl. ..... 134/27; 134/28; 134/41; 204/1 T; 204/434

[58] Field of Search ..... 204/1 T, 434, 146; 134/41, 18, 27, 28, 42

[56] References Cited

U.S. PATENT DOCUMENTS

| | | | |
|---|---|---|---|
| 2,457,234 | 12/1948 | Herbert et al. | 204/195 |
| 2,657,177 | 10/1953 | Rendel | 204/211 |
| 2,697,673 | 12/1954 | Rice | 134/15 |
| 3,684,673 | 8/1972 | Colwell | 204/129.2 |
| 3,694,334 | 9/1972 | Bombara | 204/145 |
| 3,696,017 | 10/1972 | Wallen | 204/195 |
| 3,873,512 | 3/1975 | Latanision | 204/129.46 |
| 3,943,043 | 3/1976 | Billington et al. | 204/146 |
| 4,006,063 | 2/1977 | Ensanian | 204/1 |
| 4,019,129 | 4/1977 | Grau | 324/30 |
| 4,058,438 | 11/1977 | Russell | 204/1 |
| 4,073,964 | 2/1978 | Herrmann | 427/10 |
| 4,153,517 | 5/1979 | Olson | 204/1 |
| 4,333,806 | 6/1982 | Inoue | 204/129.1 |
| 4,343,686 | 8/1982 | Hebert, Jr. et al. | 204/129.2 |
| 4,462,856 | 7/1984 | Abe et al. | 156/345 |
| 4,497,699 | 2/1985 | de Wit et al. | 204/129.2 |

*Primary Examiner*—G. L. Kaplan

[57] ABSTRACT

A method for simultaneously removing and monitoring the removal of a metallic contaminant from the surface of a metallic workpiece is disclosed. The workpiece and a reference electrode are immersed in an electrically conductive cleaning solution. The potential difference between the workpiece and the reference electrode is periodically measured to generate a series of potential difference values. Differences between successive potential difference values of the series are quantified to generate a noise parameter value. The noise parameter value is compared to a reference value, wherein the reference value is indicative of a maximum allowable amount of contaminant, to determine if an amount of contaminant greater than the maximum allowable amount of contaminant is present on the surface of the workpiece.

15 Claims, 1 Drawing Sheet

METHOD FOR MONITORING THE REMOVAL OF A METALLIC CONTAMINANT FROM THE SURFACE OF A METALLIC ARTICLE

This invention was made with Government support under Contract No. F33657-86-C-0011 awarded by the Department of the Air Force. The Government has certain rights in this invention.

TECHNICAL FIELD

This invention pertains to the cleaning of metallic surfaces and more particularly to electrochemical methods for cleaning metallic surfaces.

BACKGROUND ART

In conventional metal working processes, metallic workpieces, e.g. casting or forgings, may be encapsulated in low melting metals or metallic alloys to provide a convenient means for fixturing the workpiece during the subsequent machining operations. Low melting alloy encapsulants are well known in the art, are commercially available under a variety of trade names, e.g., Cerrobend, Cerrotru, and typically comprise combinations of such metals as bismuth, lead, tin, cadmium, antimony and zinc. Any residual encapsulant remaining after the machining operations are completed is typically removed by immersing the encapsulated workpiece in a hot oil bath to melt the encapsulant.

In certain demanding applications, e.g. gas turbine engine airfoils, the presence of even trace amounts of residual low melting alloy may have severe negative impact upon the high temperature properties of the workpiece. Fastidious cleaning and scrupulous inspection are required to ensure complete removal of the encapsulant. When a high level of cleanliness is critical, secondary cleaning steps are typically included in the removal process. Removal is particularly difficult in the case of workpieces having hidden surface area, e.g., airfoils having internal cooling passages.

In an exemplary process, the removal of the bulk of the low melting alloy from a gas turbine engine blade by melting is followed by immersion of the gas turbine engine blade in a strong acid solution to dissolve the residual low melting alloy. The gas turbine engine blades are then rinsed and individually immersed in separate aliquots of cleaning solution. After a period of time, each aliquot is analyzed by atomic absorption spectroscopy to detect the presence of dissolved low melting alloy contaminants in the aliquot. Gas turbine engine blades are recycled through the cleaning and testing steps until the concentration of dissolved contaminants has dropped below a preselected maximum concentration. The process is very time consuming and highly labor and capital intensive.

DISCLOSURE OF INVENTION

A method for simultaneously removing and monitoring the removal of a metallic contaminant from the surface of a metallic workpiece is disclosed. The workpiece and a reference electrode are immersed in an electrically conductive cleaning solution. The potential difference between the workpiece and the reference electrode is periodically measured to generate a series of potential difference values. Differences between successive potential difference values of the series are quantified to generate a noise parameter value. The noise parameter value is compared to a reference value, wherein the reference value is indicative of a maximum allowable amount of contaminant, to determine if an amount of contaminant greater than the maximum allowable amount of contaminant is present on the surface of the workpiece. The workpiece is removed from the cleaning solution.

The forgoing and other features and advantages of the present invention will become more apparent from the following description and accompanying drawings.

BEST MODE FOR CARRYING OUT THE INVENTION

Figure 1:
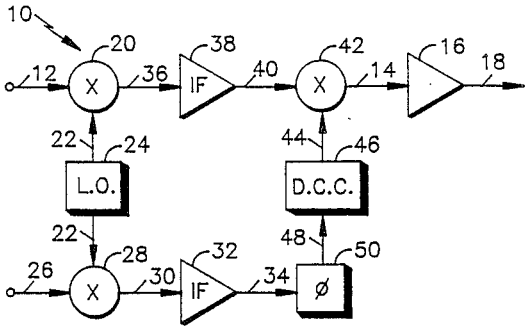
FIG. 1 is a schematic illustration of the metal cleaning apparatus of the present invention.

FIG. 1 shows a schematic of an apparatus for the practice of the present invention. Cleaning solution 2 is disposed within tank 4. Reference electrode 6 is immersed in cleaning solution 2 and is connected to voltmeter 8. Computer 10 is connected to voltmeter 8. Workpiece 12 is connected to voltmeter 8 and immersed in cleaning solution 2, so that the potential difference between workpiece 12 and reference electrode 6 may be measured using voltmeter 8. Potential difference values are processed in computer 10, as discussed below.

The method of the present invention is useful for removing low melting metallic contaminants from metallic workpieces and for monitoring the removal of the contaminant. The workpiece may comprise an alloy, based on nickel, cobalt, iron, titanium or aluminum or a refractory modified alloy, i.e. a "superalloy", based on nickel, cobalt, or iron. The low melting contaminant may comprise antimony, bismuth, cadmium, lead, tin, zinc or combinations thereof. We have found the method to be particularly useful in regard to removing an alloy of bismuth and tin from the surface of nickel base alloy gas turbine engine blades.

The reference electrode of the present invention may be any electrode which will not dissolve in the cleaning solution. Conventional metal-insoluble salt electrodes, e.g. silver/silver chloride, conventional metal-metal ion electrodes, e.g. platinum, gold or stainless steel, or conventional amalgam electrodes may be used.

The cleaning solution of the present invention may be any electrically conductive composition in which the low melting alloy may be selectively converted to soluble products, e.g. an electrolyte solution which will oxidize the low melting alloy but which will not adversely affect the surface of the workpiece. Preferably, the low melting alloy is oxidized in a strong acid solution. Chelating agents, such as nitrillotriacetic acid may be used to prevent the redeposition of the dissolved products on the surface of the workpiece.

The potential difference between the workpiece and the reference electrode may be determined in a conventional manner with a conventional potential measuring device, e.g. a volt meter. The potential measuring device may be disposed such that the potential difference between the workpiece and the reference electrode is directly measured. Alternatively, the potential difference between the workpiece and the reference electrode may be indirectly measured by connecting the reference electrode to ground and measuring the potential difference between the workpiece and ground.

In the present invention, the difference between the potential of the workpiece and the potential of the reference electrode, is measured as discussed above. A contaminated workpiece may be characterized by a corrosion potential generated by the oxidation of the contaminant in the cleaning solution. Theoretically, the potential of clean workpiece is different than the potential of a contaminated workpiece and it should be possible to differentiate between a clean workpiece and a contaminated workpiece merely by measuring the potential difference between the workpiece and the reference electrode. In practice, however, this approach has proven unreliable, in that the range of potential difference values measured for clean workpieces overlaps with the range of potential difference values measured for contaminated workpieces.

In the present invention, the potential difference is measured periodically to generate a series of potential difference values. If the potential difference between a contaminated workpiece and the reference electrode is measured with sufficient frequency as the decomposition of the contaminant progresses, significant differences may be noted between successive values, i.e. a plot of potential difference v. time shows rapid and large fluctuations. Once the oxidation of the contaminant is complete, the differences between successive potential difference values decreases and a plot of potential difference v. time approaches a smooth curve.

While not wishing to be bound by any particular theory, it is thought that the fluctuating potential difference which characterizes decomposition of the contaminant is the result of several factors, including periodic masking of the reaction sites by reaction products and the changing surface area of the contaminant. We have found that analysis of the fluctuations in potential difference value over time, i.e. the electrical noise generated during the decomposition of the contaminant, provides a reliable indicator of the presence of contaminant and allows precise discrimination between clean workpieces and contaminated workpieces. Several exemplary techniques for quantifying the fluctuations in potential difference values are set forth below.

For example, an instantaneous noise parameter, $C_i$, may be calculated as the absolute value of the difference between the rate of change of potential difference between successive potential difference measurements by:

$$C_i = ABS\left[\frac{(v_i - v_{i-1})}{(t_i - t_{i-1})} - \frac{(v_{i-1} - v_{i-2})}{(t_{i-1} - t_{i-2})}\right]$$

where:

$v_{i-2}$=potential difference at time $t_{i-2}$, $v_{i-1}$=potential difference at time $t_{i-1}$, and $v_i$=potential difference at time $t_i$.

Alternatively, a series of instantaneous noise parameter values may be smoothed by averaging or by applying a least squares fit over a rolling window containing an arbitrary number of previous readings to generate time-smoothed noise parameter value. For example, a time-smoothed noise parameter value may be generated by calculating the arithmetic average of instantaneous noise parameter values generated over the preceding 60 seconds.

Alternatively, the extent of contamination may be quantified by integrating values of the instantaneous noise parameter over the time of the cleaning cycle by:

$$C_E = \sum_{i=2}^{n} ABS\left[\frac{(v_i - v_{i-1})}{(t_i - t_{i-1})} - \frac{(v_{i-1} - v_{i-2})}{(t_{i-1} - t_{i-2})}\right](t_i - t_{i-1})$$

where:

$v_{i-2}$=potential difference at time $t_{i-2}$, $v_i-1$=potential difference at time $t_{i-1}$ and $v_i$=potential difference at time $t_i$.

Alternatively, evidence of contamination occurring near the end of a cleaning cycle may be assigned greater importance than initial contamination by calculating a weighted extent of contamination. This weighting may be accomplished by multiplying each instantaneous noise parameter value by its time into the cleaning cycle prior to numerical integration. The weighting factor $(t_{n-to})$ may be exponentiated to further emphasize the contamination detected near the end of a cleaning cycle.

$$C_{iw} = \sum_{i=2}^{n} ABS\left[\frac{(v_i - v_{i-1})}{(t_i - t_{i-1})} - \frac{(v_{i-1} - v_{i-2})}{(t_{i-1} - t_{i-2})}\right](t_i - t_{i-1})\ (t_n t_o)^x$$

where:

$v_{i-2}$=potential difference at time $t_{i-2}$, $v_{i-1}$=potential difference at time $t_{i-1}$, $v_i$=potential difference at time $t_i$ and x=weighting exponent.

Preferably, the potential difference is measured periodically over a measurement interval with a frequency of between about 1 measurement/0.01 second and about 1 measurement/10 seconds to generate a series of potential difference values. Most preferably, the potential difference is measured with a frequency of between about 1 measurement/second and 1 measurement/5 seconds.

A noise parameter reference value may then be determined wherein the reference value is indicative of a maximum allowable level of contaminant on the surface of a workpiece. A noise parameter value for a particular workpiece may then be compared to the reference value to determine whether the level of contaminant on the surface of the workpiece is greater than the maximum allowable level of contaminant. Removal of contaminant from the surface of a workpiece may be continuously monitored by periodically or dynamically calculating noise parameter values while the workpiece is immersed in the cleaning solution. Each noise parameter value may then be compared to the reference value and the workpiece removed from the cleaning solution upon determining that the level of contaminant on the surface of the workpiece is no greater than the maximum allowable amount of contaminant. Alternatively, a noise parameter value may be calculated from the potential difference values measured at or near the end of a predetermined immersion period. The workpiece is removed from the cleaning solution at the end of the immersion period. The noise parameter value is compared to the reference value. The workpiece is reimmersed for another immersion period if the amount of contaminant on the surface of the workpiece is greater than the maximum allowable amount of contaminant. The latter method is particularly convenient when cleaning a large number of workpieces simultaneously.

The method of the present invention is not sensitive to differences in temperature. It is preferred that the cleaning process be conducted at temperatures between about 60° F. and about 150° F.

After removal from the cleaning solution, any residual oxidation products are typically removed from the surface of the workpiece to complete the cleaning process. If the oxidized material is soluble in the cleaning solution, the reaction products may be removed from the surface of the workpiece by rinsing the workpiece in water. If the oxidized material is not soluble in the cleaning solution, the workpiece is immersed in a second cleaning solution, in which the reaction products are soluble, to dissolve the reaction products.

For example, in the case of the removal of a low melting alloy composition which comprises bismuth and tin (e.g. Cerrotru) from a superalloy turbine blade in a nitric acid bath further processing is required. While bismuth is apparently oxidized in the nitric acid bath to form $Bi^{+3}(No_3^-)_3$, a product which is soluble in the acid solution, tin is apparently oxidized to form $Sn.nH_2O$, known as beta-stannic acid, a product which is insoluble in the acid solution. Any residue of beta-stannic acid remaining on a superalloy workpiece is potentially harmful. We have found that the beta-stannic acid residues may be removed by cleaning the workpiece in a solution of alkali metal hydroxide. Beta-stannic acid is only sparingly soluble in LiOH or NaOH, but is quite soluble in stronger bases such as solutions of KOH, RbOH or CsOH. A 1 M solution of KOH is the preferred alkali metal hydroxide cleaning solution for removing beta-stannic acid residues. It is preferred that the alkali metal hydroxide cleaning process be conducted at a temperature below about 190° F., and particularly preferred that the process be conducted at a temperature between about 110° F. and about 150° F.

Since bismuth products are insoluble in the alkali solution, and the tin products are insoluble in the acid solution, a series of alternating acid and alkali washes may be required to ensure complete removal of the reaction products from the surface and internal passage of the turbine blade.

EXAMPLE 1

A clean turbine blade was contaminated with a low melting alloy. The blade comprised a single crystal nickel based superalloy (described in commonly assigned U.S. Pat. No. 4,209,348) and the low melting alloy comprised 58 weight % bismuth and 42 weight % tin. A small quantity (11.5 milligrams) of the low melting alloy was melted and solidified in a leading edge cooling passage of the blade. A polyethylene test cell was filled with 10 molar nitric acid at 70° F. The reference electrode used was a 2 inch square of NiCr (80 wt% Ni, 20 wt% Cr) mesh spot welded to a NiCr signal lead. Electrical connection to the test part was established by resting the part on an identical NiCr grid/signal lead assembly submerged in the solution.

Figure 2:
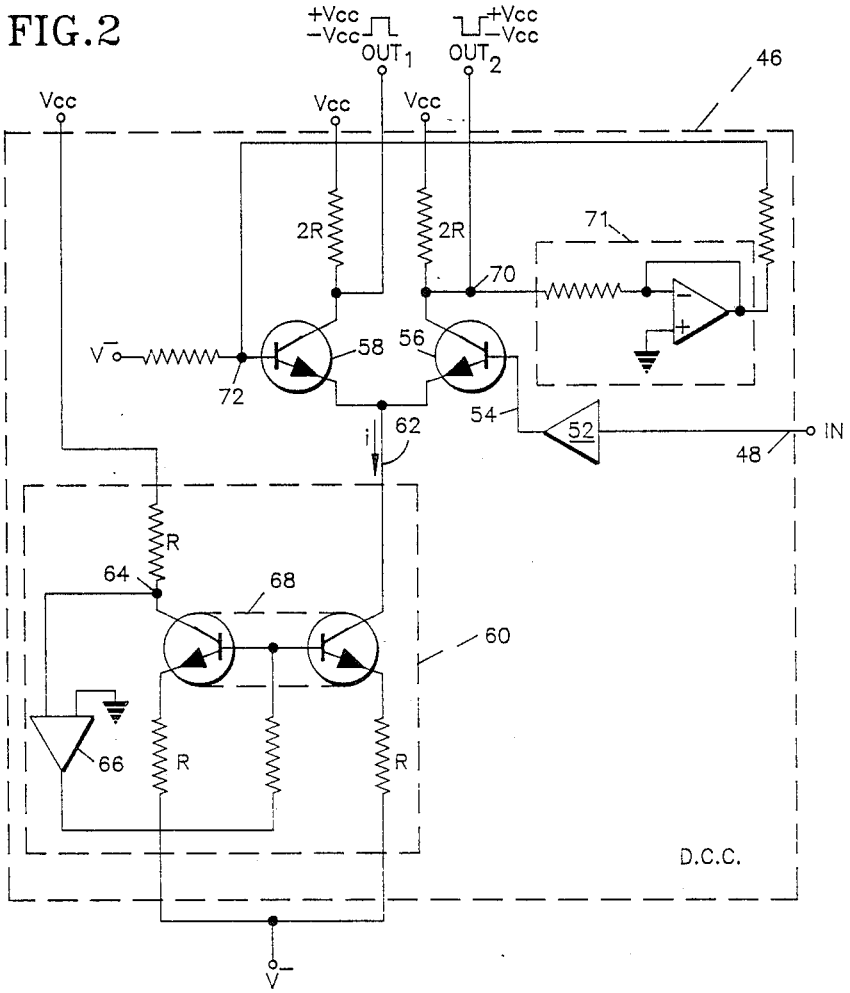
FIG. 2 shows the potential differences for a workpiece monitored over time.
Figure 1:
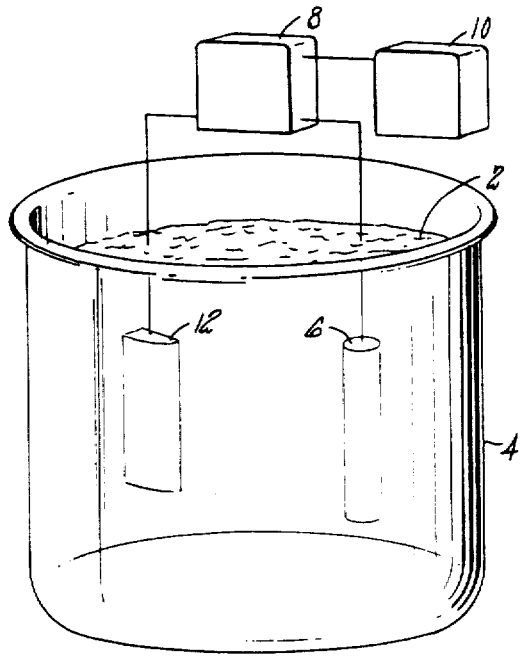
Figure 2:
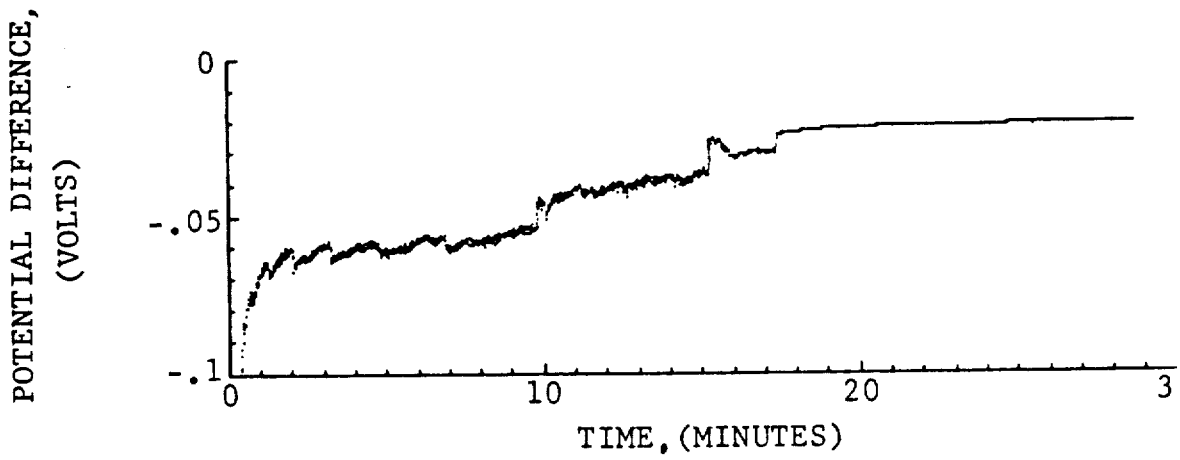
Figure 3:
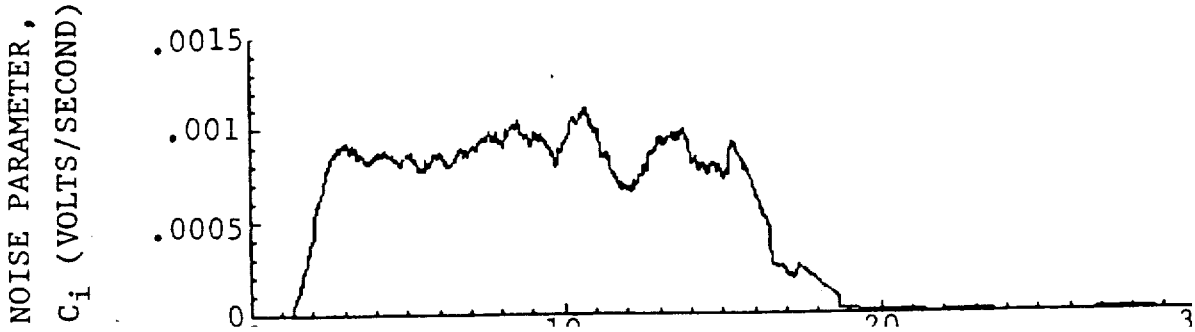
FIG. 3 shows the noise parameter calculated from the potential differences in FIG. 2 over time.

The potential difference between the blade and the reference electrode was monitored for 29 minutes. The difference between the turbine blade and the reference electrode was measured once per second with respect to the reference electrode to a precision of $+/-10^{-7}$ volts. The instantaneous noise parameter, $C_i$, was averaged over a rolling window of sixty seconds. A plot of potential difference versus time is given in FIG. 2. A plot of the instantaneous noise parameter calculated from the potential difference values versus time is given in FIG. 3. The dissolution of the low melting alloy contaminant was monitored visually. The complete dissolution of the contaminant was seen to be coincident with the drop in noise parameter to below a value of $10^{-4}$ volts/second.

EXAMPLE 2

Three hundred eighty nickel alloy turbine blades were immersed in a nitric acid cleaning solution for a period of 29 minutes. The blades were each monitored during the immersion period using the method of the present invention. At the end of the immersion period, three blades exhibited instantaneous noise parameter values, $C_i$, greater than a reference value of $10^{-4}$ volts/-second. Radiographic and spectroscopic inspection confirmed that the three blades were contaminated with an alloy of bismuth and tin. The other 377 blades were inspected by radiographic and spectroscopic techniques and found to be free of low melting alloy contaminant.

EXAMPLE 3

The experiment of Example 1 was repeated using an alloy of Bi, Cd, Pb and Sn as the low melting alloy contaminant. Again the noise parameter, $C_i$, was calculated dynamically and found to drop below the value of $10^{-4}$ volt/second coincident with the complete dissolution of the contaminant feature.

EXAMPLE 4

Example 1 was repeated using type metal (alloy of Pb, Sb and Sn) as the low melting alloy contaminant. Complete dissolution of the feature was seen to be coincident with a drop in the instantaneous noise parameter, $C_i$, to a value below $10^{-4}$ volts/second.

EXAMPLE 5

The experiment of Example 1 was repeated using zinc as the low melting alloy contaminant. The zinc dissolved within 3 minutes and the complete dissolution of the contaminant was again seen to be coincident with the drop in the instantaneous noise parameter, $C_i$, to a value below $10^{-4}$ volts/second.

Although this invention has been shown and described with respect to detailed embodiments thereof, it will be understood by those skilled in the art that various changes in form and detail thereof may be made without departing from the spirit and scope of the claimed invention.

The method of the present invention allows simultaneous removal and measurement of the removal of low melting alloy contaminants from the surface of metallic workpieces and avoids the production bottleneck associated with the use of prior art cleaning and quality control techniques.

We claim:

1. A method for simultaneously removing and monitoring the removal of a contaminant from the surface of an workpiece, wherein the workpiece comprises a first metal and the contaminant comprises a second metal, comprising:

(a) immersing the workpiece and a reference electrode in an electrically conductive cleaning solution, (b) periodically measuring the potential difference between the workpiece and the reference electrode to generate a series of successive potential difference values, (c) quantifying fluctuations between successive potential difference values of the series to generate a noise parameter value, (d) comparing the noise parameter value to a reference value, wherein the reference value is indicative of a maximum allowable amount of contaminant on the surface of the workpiece, to determine if an amount of contaminant greater than the maximum allowable amount of contaminant is present on the surface of the workpiece, (e) removing the workpiece from the cleaning solution.

2. The method of claim 1, wherein the cleaning solution comprises an aqueous solution of nitric acid.

3. The method of claim 1, wherein the first metal comprises an alloy based on nickel, cobalt, iron, titanium or aluminum or a superalloy based on nickel, cobalt or iron.

4. The method of claim 1 wherein the second metal comprises antimony, bismuth, cadmium, lead, tin, zinc or mixtures thereof.

5. The method of claim 1, wherein the differences between successive potential difference values of the series are quantified by calculating a noise parameter value, $C_i$, according to the formula:

$$C_i = \left[ \frac{(v_i - v_{i-1})}{(t_i - t_{i-1})} - \frac{(v_{i-1} - v_{i-2})}{(t_{i-1} - t_{i-2})} \right],$$

where:

$v_{i-2}$=potential difference value at time $t_{i-2}$, $v_{i-1}$=potential difference value at time $t_{i-1}$ and $v_i$=potential difference value at time $t_i$.

6. The method of claim 5 wherein the differences between successive potential difference values are quantified by calculating a time-smoothed noise parameter value and the time-smoothed noise parameter value is compared to the reference value.

7. The method of claim 6 wherein the time-smoothed noise parameter value is calculated by averaging a series of noise parameter values, $C_i$, over a rolling time interval.

8. The method of claim 5 wherein the time-smoothed noise parameter value is calculated by a least squares curve fit to a series of noise parameter values, $C_i$, over a rolling time interval.

9. The method of claim 1, wherein the differences between successive potential difference values of the series are quantified by calculating a noise parameter value, $C_E$, according to the formula:

$$C_E = \sum_{i=2}^{n} ABS \left[ \frac{(v_i - v_{i-1})}{(t_i - t_{i-1})} - \frac{(v_{i-1} - v_{i-2})}{(t_{i-1} - t_{i-2})} \right] (t_i - t_{i-1}),$$

where:

$v_{i-2}$=potential difference value at time $t_{i-2}$, $v_{i-1}$=potential difference value at time $t_{i-1}$ and $v_i$=potential difference value at time $t_i$.

10. The method of claim 1, wherein the differences between successive potential difference values of the series are quantified by calculating a noise parameter value, $C_{iw}$, according to the formula:

$$C_{iw} = \sum_{i=2}^{n} ABS \left[ \frac{(v_i - v_{i-1})}{(t_i - t_{i-1})} - \frac{(v_{i-1} - v_{i-2})}{(t_{i-1} - t_{i-2})} \right] (t_i - t_{i-1}) \ (t_n t_o)^x,$$

where:

$v_{i-2}$=potential difference value at time $t_{i-2}$, $v_{i-1}$=potential difference value at time $t_{i-1}$, $v_i$=potential difference value at time $t_i$ and x=weighting exponent.

11. The method of claim 1, additionally comprising:

repeating steps b, c, and d prior to step e until it is determined that an amount of contaminant greater than the maximum allowable amount of contaminant is not present on the surface of the workpiece.

12. The method of claim 1, additionally comprising:

repeating steps a, b, c, d and e if it is determined that an amount of contaminant greater than the maximum amount of contaminant is present on the surface of the workpiece.

13. The method of claim 1 wherein during immersion of the workpiece in the cleaning solution the contaminant is converted to a product which is insoluble in the cleaning solution, additionally comprising:

(f) immersing the workpiece in a second solution, wherein the product is soluble, to dissolve the product, (g) removing the workpiece from the second solution.

14. The method of claim 13, wherein the cleaning solution comprises an acid solution and the second solution comprises an alkali metal hydroxide solution.

15. the method of claim 14, wherein the alkali metal hydroxide comprises KOH, CsOH or RbOH or mixtures thereof.

* * * * *

UNITED STATES PATENT AND TRADEMARK OFFICE

CERTIFICATE OF CORRECTION

PATENT NO. : 4,886,552

DATED : December 12, 1989

INVENTOR(S) : Mark R. Jaworowski, Gary A. Gruver

It is certified that error appears in the above-identified patent and that said Letters Patent is hereby corrected as shown below:

The title page should be deleted to appear as per attached title page. The sheet of drawing consisting of figures 1 and 2 should be deleted to appear as per attached sheet.

Signed and Sealed this

Eleventh Day of June, 1991

*Attest:*

HARRY F. MANBECK, JR.

*Attesting Officer*

*Commissioner of Patents and Trademarks*

United States Patent [19]

Jaworowski et al.

[11] Patent Number: 4,886,55

[45] Date of Patent: Dec. 12, 198

[54] METHOD FOR MONITORING THE REMOVAL OF A METALLIC CONTAMINANT FROM THE SURFACE OF A METALLIC ARTICLE

[75] Inventors: Mark R. Jaworowski, Enfield; Gary A. Gruver, South Windsor, both of Conn.

[73] Assignee: United Technologies Corporation, Hartford, Conn.

[21] Appl. No.: 242,759

[22] Filed: Sep. 9, 1988

[51] Int. Cl.[4] ..... C23G 1/02; C23G 1/08; C23G 1/10; C23G 1/12

[52] U.S. Cl. ..... 134/27; 134/28; 134/41; 204/1 T; 204/434

[58] Field of Search ..... 204/1 T, 434, 146; 134/41, 18, 27, 28, 42

[56] References Cited

U.S. PATENT DOCUMENTS

| | | | |
|---|---|---|---|
| 2,457,234 | 12/1948 | Herbert et al. | 204/195 |
| 2,657,177 | 10/1953 | Rendel | 204/211 |
| 2,697,673 | 12/1954 | Rice | 134/15 |
| 3,684,673 | 8/1972 | Colwell | 204/129.2 |
| 3,694,334 | 9/1972 | Bombara | 204/145 |
| 3,696,017 | 10/1972 | Wallen | 204/195 |
| 3,873,512 | 3/1975 | Latanision | 204/129.46 |
| 3,943,043 | 3/1976 | Billington et al. | 204/146 |
| 4,006,063 | 2/1977 | Ensanian | 204/ |
| 4,019,129 | 4/1977 | Grau | 324/3 |
| 4,058,438 | 11/1977 | Russell | 204/ |
| 4,073,964 | 2/1978 | Herrmann | 427/1 |
| 4,153,517 | 5/1979 | Olson | 204/ |
| 4,333,806 | 6/1982 | Inoue | 204/129. |
| 4,343,686 | 8/1982 | Hebert, Jr. et al. | 204/129. |
| 4,462,856 | 7/1984 | Abe et al. | 156/34 |
| 4,497,699 | 2/1985 | de Wit et al. | 204/129. |

*Primary Examiner*—G. L. Kaplan

[57] ABSTRACT

A method for simultaneously removing and monitoring the removal of a metallic contaminant from the surface of a metallic workpiece is disclosed. The workpiece and a reference electrode are immersed in an electrically conductive cleaning solution. The potential difference between the workpiece and the reference electrode is periodically measured to generate a series of potential difference values. Differences between successive potential difference values of the series are quantified to generate a noise parameter value. The noise parameter value is compared to a reference value, wherein the reference value is indicative of a maximum allowable amount of contaminant, to determine if an amount of contaminant greater than the maximum allowable amount of contaminant is present on the surface of the workpiece.

15 Claims, 1 Drawing Sheet

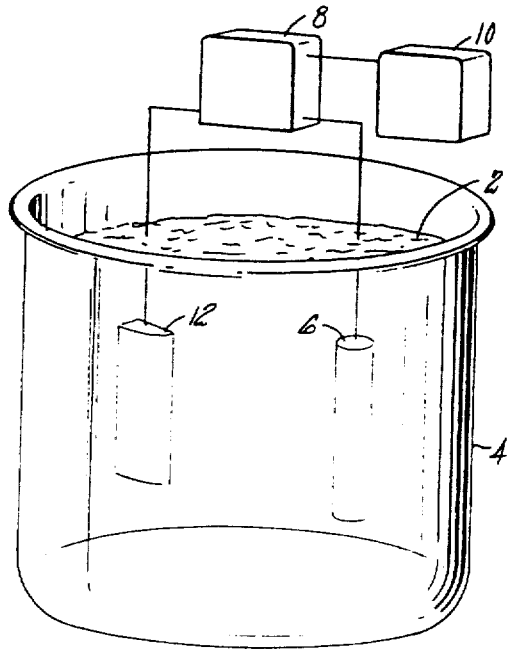

FIG. 1